United States Patent [19]

Gunther

[11] Patent Number: 5,052,165

[45] Date of Patent: Oct. 1, 1991

[54] PROCESS AND DEVICE FOR APPLICATION OF A CARRYING GRIP DURING THE AUTOMATIC SEALING OF CARTONS

[75] Inventor: Werner T. Gunther, Neuss, Fed. Rep. of Germany

[73] Assignee: Minnesota Mining and Manufacturing Company, St. Paul, Minn.

[21] Appl. No.: 190,130

[22] Filed: May 4, 1988

[30] Foreign Application Priority Data

May 8, 1987 [DE] Fed. Rep. of Germany ..... 3715445

[51] Int. Cl.[5] ..... B65B 61/14

[52] U.S. Cl. ..... 53/413; 53/415; 156/361; 156/486; 156/522

[58] Field of Search ..... 53/134, 137, 413, 415, 53/134.1, 136.1; 156/353, 361, 486, 489, 510, 516, 517-522, 552, 566; 493/88, 221, 347, 382, 909

[56] References Cited

U.S. PATENT DOCUMENTS

| | | | |
|---|---|---|---|
| 3,437,544 | 4/1969 | Wilcox | 53/134 |
| 3,834,970 | 9/1974 | Mitsuoka et al. | 156/521 X |
| 4,294,058 | 10/1981 | Rensner | 53/413 |
| 4,415,399 | 11/1983 | Geisinger | 156/489 X |
| 4,640,731 | 2/1987 | Lerner et al. | 156/511 X |
| 4,716,707 | 1/1988 | Gambetti | 53/134 |
| 4,758,301 | 7/1988 | Tnoko et al. | 156/361 |
| 4,789,418 | 12/1988 | Rayl | 156/486 X |

FOREIGN PATENT DOCUMENTS

| | | |
|---|---|---|
| 2038066 | 2/1971 | Fed. Rep. of Germany . |
| 2120201 | 11/1983 | United Kingdom . |
| 2206557 | 1/1989 | United Kingdom . |

OTHER PUBLICATIONS

Brochure entitled "Tesa Handylift," undated, BDF tesa Ltd., 3 pages.

Brochure entitled "Tape Handle Dispenser," undated, 2 pages, Midway Machine Company.

*Primary Examiner*—John Sipos

*Attorney, Agent, or Firm*—Gary L. Griswold; Walter N. Kirn; Leland D. Schultz

[57] ABSTRACT

A process for application of a carrying grip or handle by means of adhesive tape to a row of continuously moving cartons during automatic packing and sealing operations, wherein each case a predetermined length of adhesive tape is applied automatically to each carton, whereby between the attachment of the two ends of the predetermined length of adhesive tape on the carton, the adhesive tape is acted upon by a movement which is different with respect to at least one parameter from the movement of the carton, thus forming the excess length which constitutes the handle. The adhesive side of the excess length of adhesive tape has been previously covered or masked automatically with a cover tape in an operational step which is synchronized with the application of the adhesive tape to the carton.

4 Claims, 5 Drawing Sheets

PROCESS AND DEVICE FOR APPLICATION OF A CARRYING GRIP DURING THE AUTOMATIC SEALING OF CARTONS

TECHNICAL FIELD

The invention concerns a process for application of a carrying grip or handle onto cartons which are continuously moving in a row by means of an adhesive tape and a device for carrying out this process.

It is known that cartons of the same dimensions which are continuously moving in a row on a conveyor belt can be automatically closed or sealed by means of an adhesive tape. This kind of device has proven itself in this respect to be effective in that a relatively large number of cartons can be handled rather quickly. But during subsequent loading and transportation of the cartons, the absence of a handle and the disadvantages associated with this become apparent. Often a carrying grip or handle in the form of a cord will be fastened onto a carton which has already been sealed. This, however, requires labor and additional expense.

One known carton closing machine of this type has a continuously driven conveyor belt for the cartons and a supply device with a supply roll for the adhesive tape. The machine has further a mechanism which has a swivel-mounted lever bar with rolls, at least one of which can be brought in contact with surfaces of the carton in order to press on the adhesive tape. Furthermore there is provided a knife mounted on a bar for cutting off a measured strip of tape for the carton. By means of the movement of the carton and a suitable mechanism consisting of levers and rolls, the adhesive tape is pulled off of the supply roll and applied to the cartons which are to be closed.

It is known further, that a carrying handle can be designed from adhesive tapes, whereby the adhesive tape is led from a supply roll over suitable additional rolls and a masking or cover tape is likewise led in from a supply roll and over suitable guide rolls and the cover tape is cut with a knife, so that a predetermined length of the adhesive side of the adhesive tape is covered by the cover tape. By means of a further cutting device, measured sections which lie to both sides of the area of the adhesive tape which is covered are cut off, so that one obtains a strip which can be applied with both ends to objects so that they can be carried.

DISCLOSURE OF THE INVENTION

The invention provides for a process of the previously mentioned sort as well as a device for carrying out this process, also mentioned in the introduction, so that cartons of the same dimensions can be provided with a handle made of adhesive tape by means of applying an adhesive tape during the continuous closing or sealing operations.

The invention demonstrates itself to be particularly advantageous in that each of a row of continuously moving cartons can be provided with a handy carrying grip which is an integral part of the adhesive tape that is used to close the cartons. The total length (of the adhesive strip) $= Za + (x + y) + Ze$, where Za is the beginning length, x is the carton length, y is the extra length for the handle and Ze is the end length. These parameters are adjustable and especially the extra length for the handle can be selected and set by the operator of the device, whereby the production of the handle can be generated by use of the friction effect of a friction roll with a controlled drive, or by means of a suitable entrainment device which comes in contact with the adhesive tape. The friction roll can be driven by means of a separately controlled electric motor, a compressed air drive or any other suitable drive box. A drive makes use of differing coefficients of friction to deliver the predetermined excess length of adhesive tape for the handle has proven itself to be very effective.

If the handle forming assembly which has been added according to the current invention is shut off and the friction roll swung away so that application of the cover paper onto the adhesive tape does not occur and an excess length of tape is not created by the friction roll, then the device described by this invention can be used like a conventional carton-closing machine.

It has been demonstrated to be advantageous that during the application of the tape to the surface of the carton that the application roll should be provided with a rubber surface in order to take advantage of certain electrostatic effects, so that the backside or adhesive free side of the adhesive tape wraps itself around the application roll without mechanical assistance.

The handle forming assembly which automatically controls the covering of the adhesive side of the section of the adhesive tape corresponding to the excess length of the adhesive tape which forms the handle by a cover tape (paper), this covering process being synchronized with the application of the adhesive tape, is preferably made out of an incremental sensor which is designed as a measuring device for determining the position of the cover or paper tape. The transition between the adhesive layer of the adhesive tape and the covering paper tape is recognizable by the incremental sensor. Displacement of the paper tape in either of two directions (which could occur occasionally due to slight variations in the cartons) can be corrected by means of the incremental sensor which can detect the starting point of the paper tape. For this purpose the handle forming assembly can transport adhesive tape over a roll in two directions.

BRIEF DESCRIPTION OF THE DRAWINGS

Preferred designs of the device described in this invention whose purpose is to carry out the process described herein are illustrated by the accompanying drawings. These are.

DETAILED DESCRIPTION

Figure 1:
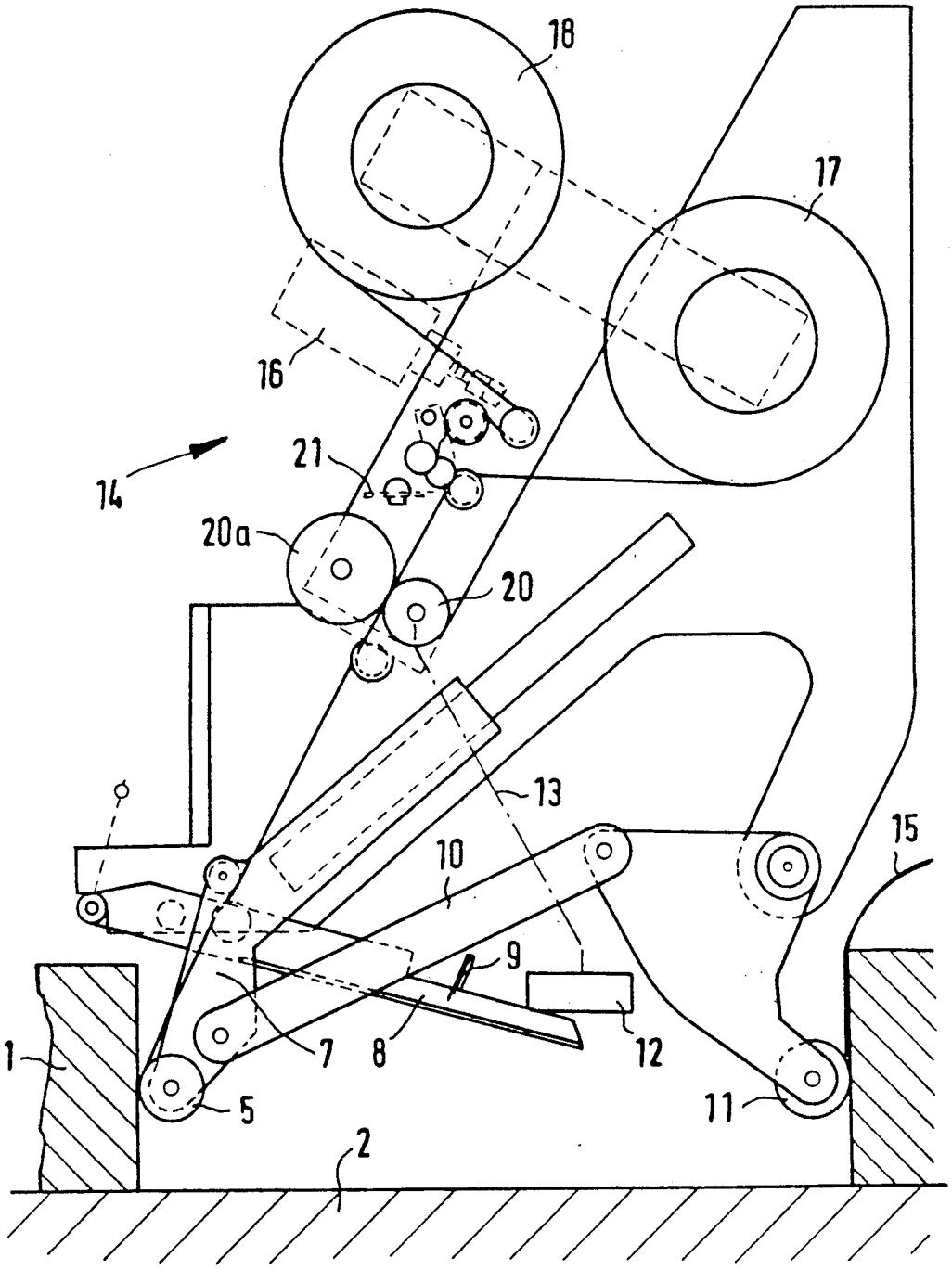
FIG. 1 a side view of a design of the invention which makes use of a friction effect during the beginning of the adhesion of the prepared handle to the carton.
Figure 2:
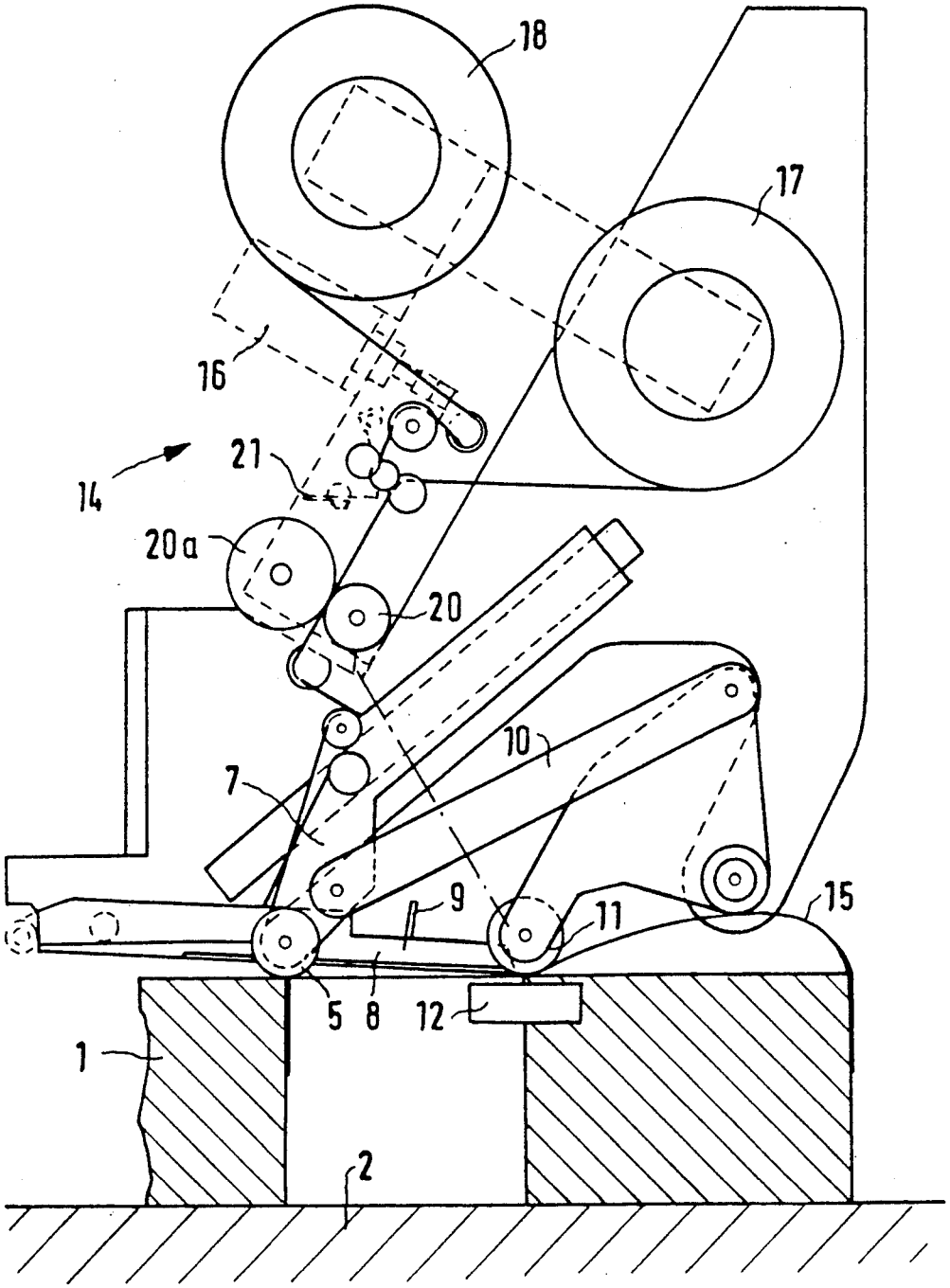
FIG. 2 a drawing similar to that in FIG. 1 where the application of the handle is nearly complete.
Figure 3:
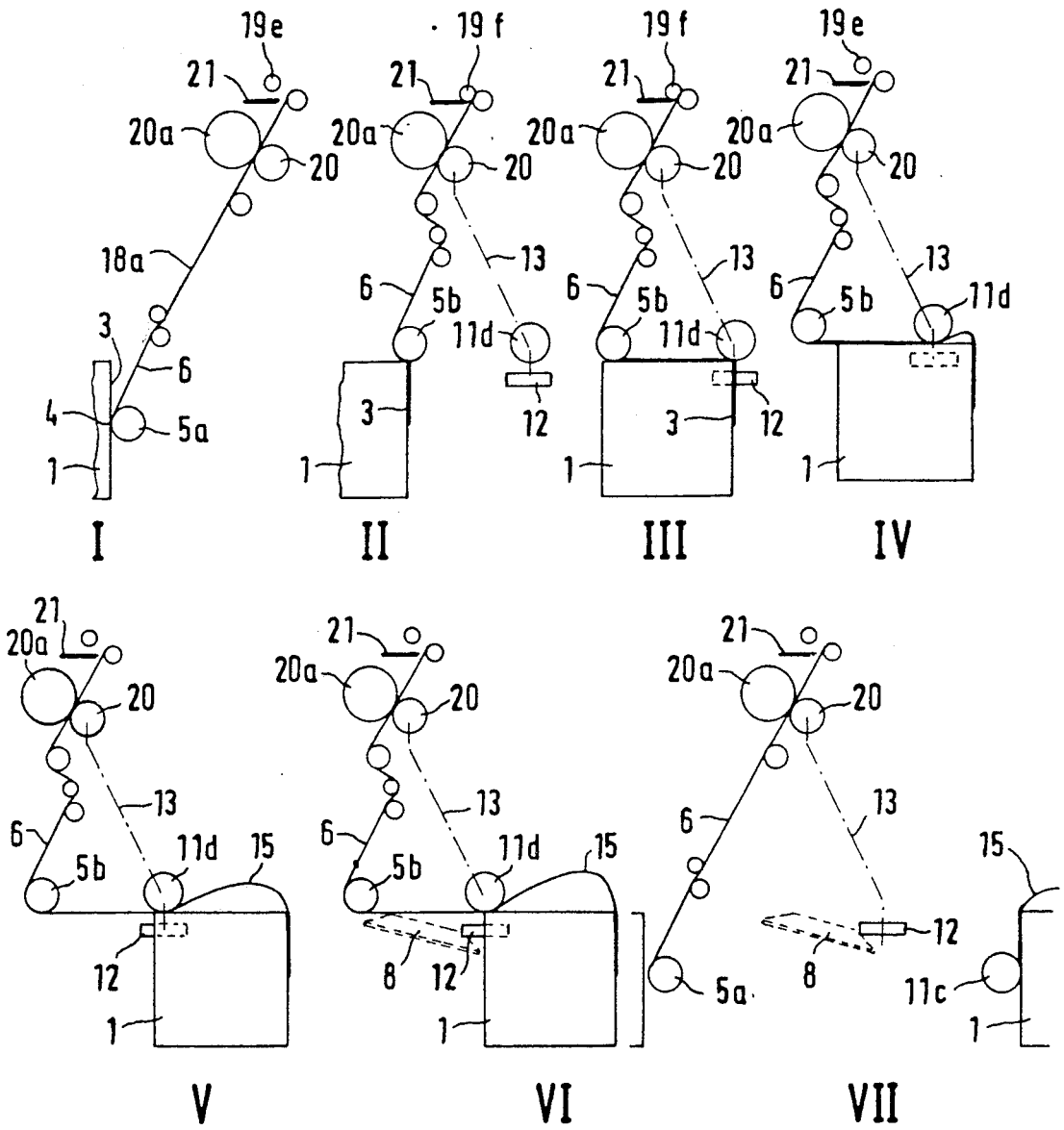
FIG. 3 a flow chart of seven steps I–VII which shows the method of operation of the design of the invention as represented in FIGS. 1 and 2.

As can be seen from FIGS. 1 and 3 I, the carton 1 is moved on the conveyor belt 2 through the device until the front face 3 of the carton 1 touches the front application roll 5. The beginning of the adhesive tape 6 which sticks to the front face 3 of the carton 1 is located on the front application roll 5.

As a result of further motion of the carton 1, a lever 7 performs a lifting motion, whereby the front application roll 5 rolls upward over the front face 3 of the carton 1 and thereby moves from its first position "a" to its second position "b". During this process the adhesive tape 6 is pressed onto the face 3 by the application roll 5 as shown in FIG. 3 II.

As the application roll 5 moves, a rear application roll 11 is moved from its first position "c" to its second position "d" by means of the lever 7 and the rod 10. After this movement the rear application roll 11 is at the same height as the front application roll 5, this height being namely one which corresponds to the top side of the carton. As a result of the motions just described, a knife holder 8 which bears a knife 9 slides across the upper surface of the carton. As the carton 1 moves further through the device, the rear application roll 11 in its second position "d" rolls over the upper edge of the front face 3 as shown in FIG. 3 III.

Simultaneously, a side supporting roll 12 comes in contact with a side edge of the front face 3 and begins to turn. The turning of the side supporting roll 12 activates the handle forming assembly 14 by means of a shaft or rod. The integrated unit 14 then carries out and controls the following functions.

The handle forming assembly 14 drives the rear application roll 11 by means of an electric motor (not pictured). The surface of the rear application roll 11 is so constructed so that the coefficient of friction between the rear application roll 11 and the adhesive-free side of the adhesive tape 6 is greater than the coefficient of friction between a predetermined length of cover tape (used to mask the adhesive side of the adhesive tape) and the upper side of the carton 1. The cover tape is made preferably of paper. The rear application roll 11 is turned fast enough by the electric motor so that more adhesive tape is advanced or drawn off the roll than would be required to tape the length of the carton 1 in the direction in which it is moving. Because of the differing coefficients of friction, the adhesive tape 6 is moved faster than the carton, resulting in a excess length of adhesive tape 6 which forms the desired handle.

The handle forming assembly 14 further operates an electromagnet 16 which effects the partial masking of the adhesive tape 6 with the cover tape 18*a*. For this purpose an adhesive tape roll 17 and additionally a paper tape roll 18 are mounted on the device.

As the side supporting roll 12 moves over the side edge of the front face 3 of the carton 1, it begins to turn. This causes the adhesive tape feeding roll 20 to generate the desired excess length of adhesive tape 6 by means of rods 10 and mechanical translation or by means of the strenqth of an electric motor. This excess length of tape is then fashioned into a handle 15 by the rear application roll 11 utilizing the differing coefficients of friction as described previously. See FIGS. 3 IV–V.

As soon as the counting roll 20*a* (which is driven by the tape feeding roll 20) turns, the electromagnet is actuated by a number of impulses generated by an incremental sensor, such as an electro-optical element, (not pictured) in the handle forming assembly 14. The electromagnet 16 brings a guide roll 19 from position "e" into position "f" as shown in FIGS. 3 III–IV, whereby the paper tape from the paper tape roll 18 is pressed onto the adhesive side of the adhesive tape 6. The length of the cover tape 18*a* (made of paper) which is applied to the adhesive tape 6 is that in accordance with the number of impulses generated by the incremental sensor in the handle forming assembly 14. The adhesive tape 6 has at this point been transformed into a handle 15.

According to number of impulses generated by the incremental sensor in the handle forming assembly 14 the electromagnet 16 is switched and moves the guide roll 19 from position "f" back to position "e".

This causes the cover tape 18*a* to be cut off by the stationary knife 21. The covering of the adhesive layer of the adhesive tape 6 is thereby ended as shown in FIG. 3 IV As soon as the side supporting roll 12 reaches the rear side edge of the carton 1 as shown in FIG. 3 V and subsequently stops turning, then the turning of the adhesive tape feeding roll 20 also stops. At the same moment the handle forming assembly 14 is deactivated and as a result the rear application roll 11 ceases to be driven by the electric motor.

As soon as the knife holder whose end has slid across the upper side of the carton 1 is released at the rear edge of the carton 1, it falls down with a spring action, whereby the knife 9 cuts through the adhesive tape 6 and thereby determines the length of the adhesive tape. The length of adhesive tape which is to be adhered to the carton can be set by changing the position of the knife in the knife holder. The knife 9 can be designed as a heatable knife for adhesive tapes or cover tapes which are difficult to cut.

As soon as the rear application roll 11 has reached the rear edge of the carton 1, as shown in FIG. 3 VII, it moves downward along the rear face 3*a* of the carton 1 and presses the end of the adhesive tape onto the face of the carton 1 until the rear application roll 11 returns to its original position "c".

The front application roll 5 and the knife holder 8 are also led back into their original positions "a" by means of the rod 10 and the lever 7. The front application roll 5 is then ready for application of a further handle to the next carton The following data must be entered into the handle forming assembly 14 in order to achieve the desired masking of the exposed adhesive layer and thus the formation of the handle 15 on the adhesive tape 6.

1. Beginning length Za (fixed, constant)
2. Carton length X
3. Excess length for the Handle y
4. End length Ze (fixed, constant)

The total length G of the tape section, which is required for the handle of a carton is given by:

$$Za+x+y+Ze=G,$$

whereby x+y is the length of the adhesive tape section which is to be masked with cover tape.

The beginning and end lengths Za and Ze can be of a length of 70 mm, for example, which could nevertheless be changed at any time to suit other structural requirements.

Figure 4:
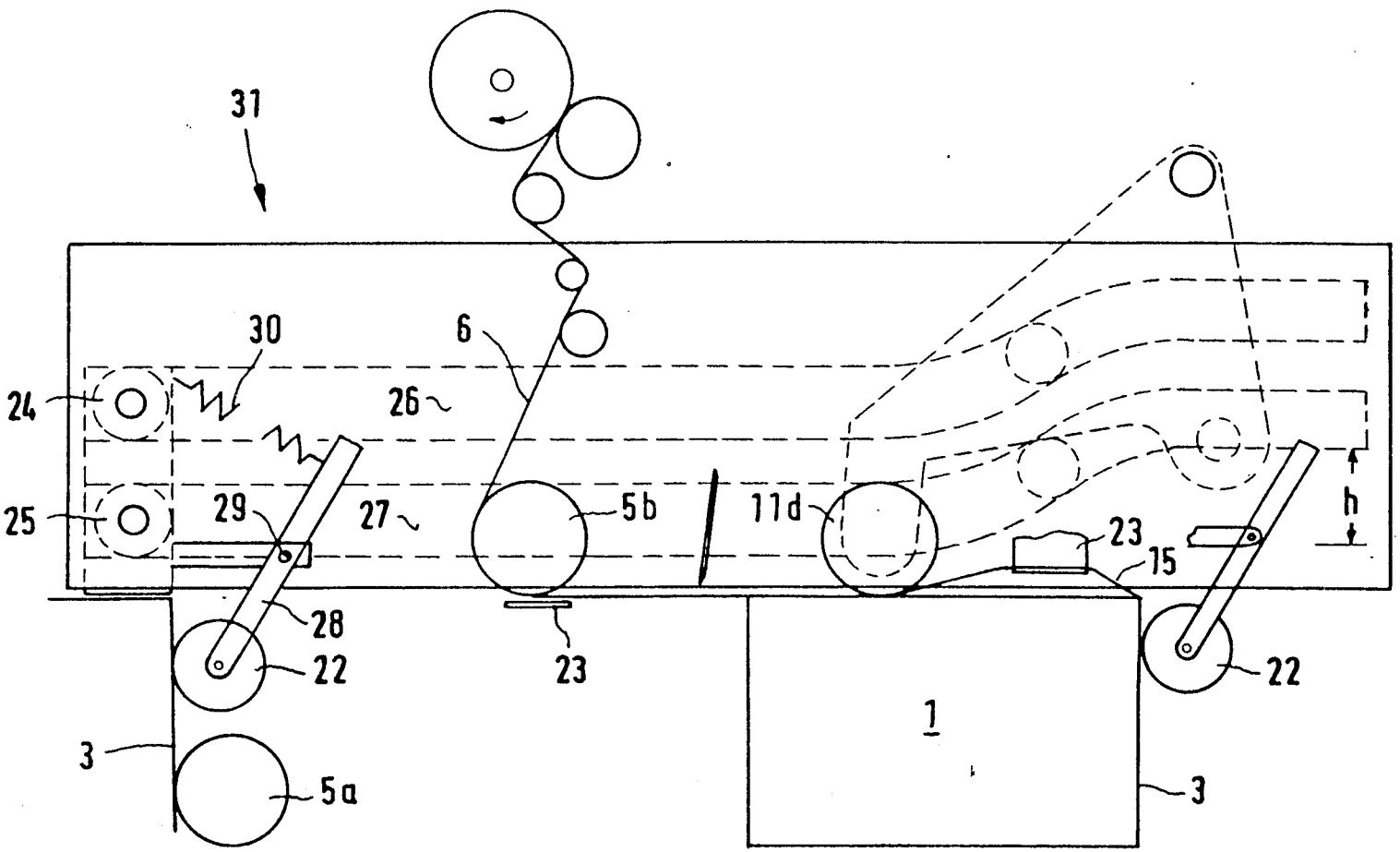
FIG. 4 a schematic representation of a front view of a different form of the invention which has an entrainment device or ripper.
Figure 5:
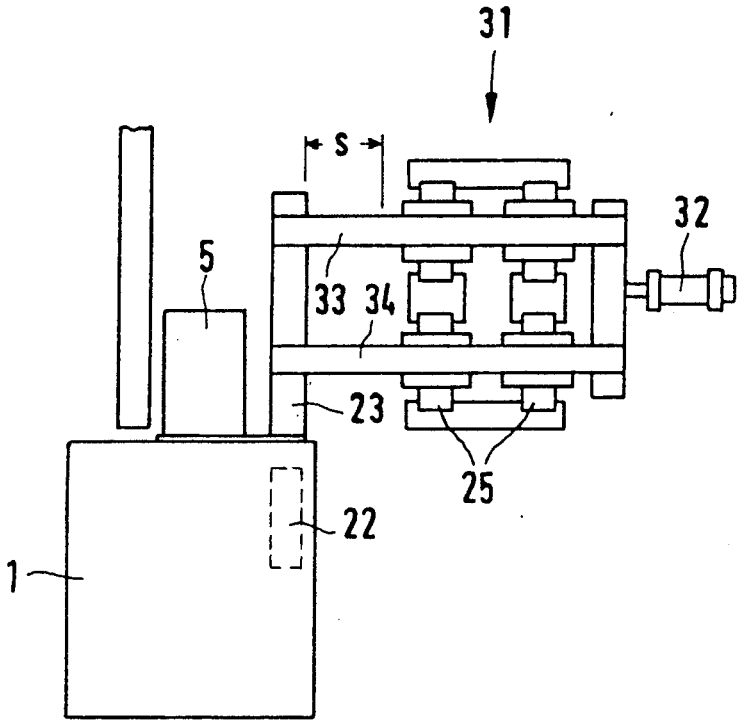
FIG. 5 a side view of the design of the invention which is represented in FIG. 4.

A further design of the handle forming assembly which can be used to produce an excess length of tape and therefore a handle includes an entrainment mechanism represented in FIGS. 4 and 5.

As represented in FIG. 4, the entrainment mechanism includes a tape assistant roll 22 is attached to an assistant roller lever 28 so that it can be pivoted at a bearing 29. A retaining spring 30 is provided between the other end of the assistant roller lever 28 and a guiding device 31.

The guiding device has guide rails or tracks 26 and 27 in which the guide rolls 24 and 25 move. As represented, the guide rails run at first horizontally, i.e. parallel to the direction of movement of the carton. Then in about the last third of the movement they lead upwards along a climbing track and then again in a horizontal fashion.

As represented in FIG. 5, the front application roll 5 and the tape assistant roll 22 lie in two differing vertical planes as seen from the direction in which the carton is moving. The hook 23 hangs on the guide drafts 33 and 34 whereby the horizontal part of the hook is arranged directly in the area over the upper side of the carton 1 or actually touches it slightly. The front application roll 5 moves just over the horizontal part of the hook 23. If necessary the hook 23 can be pushed to the right by a cylinder 32 along the path s in order to take the horizontal part of the hook 23 out of the way of the adhesive tape 6 which is guided by the front application roll 5.

The method of operation of this design of the device will be explained with FIGS. 4 and 5 which follow.

As soon as the carton 1 runs up against the front application roll 5 which is in its first position "a", the tape assistant roll 22 also touches the front face 3 of the carton 1. As previously described, the front application roll 5 and the tape assistant roll 22 are at different lateral locations, so that as the carton 1 moves further through the device the front application roll 5 can move unimpeded from its first position "a" to its second position "b".

The tape assistant roll 22 moves in a horizontal direction through the device with the carton 1 and thereby serves as mechanism of entrainment for the guide device 31 which consists of the hook 23, the guide rolls 24 and 25, the guide drafts 33 and 34 as well as the guide rails 26 and 27. With the help of the guide rolls 24 and 25, the hook 23 moves over the guide rails 26 and 27. As the carton moves along, the front application roll 5 rolls over the horizontal part of the hook 23 and finally into its second position "b", the horizontal part of the hook now being in a position under the covered section of the adhesive tape 6.

The hook 23 is raised by means of the upward inclining part of the guide rails 26 and 27, whereby the covered section of tape 6 is pulled along with it and the extra length required for the handle 15 is pulled upwards according to the inclination of the guide rails 26 and 27.

This lifting is achieved by mechanical means in the design of the invention represented here, but it can also be accomplished by means of other suitable devices such as, for example, a spindle or by means of hydraulically or pneumatically driven cylinder.

When the lifting motion of the hook 23 has reached its final position, the hook 23 is moved out of the way of the handle 15 by a sideways displacement approximately along the path s as shown in FIG. 5. The return of the moving parts of the entrainment mechanism along with the tape assistant roll 22 and the hook 23 to the starting position is achieved by means of a return spring or a suitable pressure-activated cylinder.

I claim:

1. A process for application of a handle onto cartons which are continuously moving in a row, comprising the steps of:

(a) providing a supply roll of pressure sensitive adhesive tape;

(b) attaching one end of the adhesive tape to one of the cartons;

(c) generating a length of adhesive tape in excess of a length of the carton in the direction of movement thereof by a parameter of direction or speed of movement of the adhesive tape which is different than the direction or speed of movement of the carton;

(d) covering a predetermined length of the adhesive surface of the adhesive tape with a cover tape having a width generally the same as the adhesive tape and a length generally the same as the excess length of the adhesive tape generated in step (c) and the length of the cartons, forming the handle, synchronized with the application of the adhesive tape to the carton;

(e) severing a predetermined length of the adhesive tape including the excess length of adhesive tape from the supply roll of adhesive tape; and (f) attaching the severed end of the predetermined length of adhesive tape to the carton, whereby the predetermined length of the adhesive tape intermediate the attached ends of the adhesive tape forms the handle on the carton.

2. A process according to claim 1, wherein step (c) includes the step of driving the adhesive tape with a translational speed which is greater than the speed of the carton after the attachment of the first end of the adhesive tape in step (b) to generate the excess length of adhesive tape.

3. A process according to claim 1, wherein step (c) includes the steps of providing an entrainment mechanism for engaging the adhesive tape after step (b); and pulling the adhesive tape away from the carton to generate the excess length of adhesive tape.

4. A process according to claim 1, wherein one end of the adhesive tape is attached to the front side of the carton and the other end of the adhesive tape is attached to the rear side of the carton so that the adhesive tape forming the handle extends over the top side of the carton.

* * * * *